United States Patent [19]

Toramoto

[11] Patent Number: 4,969,843

[45] Date of Patent: Nov. 13, 1990

[54] ELECTRICAL PLUG CONNECTOR

[75] Inventor: Hisao Toramoto, Kyoto, Japan

[73] Assignee: Hosiden Electronics Co., Ltd., Osaka, Japan

[21] Appl. No.: 447,315

[22] Filed: Dec. 7, 1989

[30] Foreign Application Priority Data

Jan. 7, 1989 [JP] Japan ..... 1-729

[51] Int. Cl.[5] ..... H01R 13/40

[52] U.S. Cl. ..... 439/695

[58] Field of Search ..... 439/695, 686, 701, 736, 439/885; 29/884, 883

[56] References Cited

U.S. PATENT DOCUMENTS

| | | | |
|---|---|---|---|
| 3,258,831 | 7/1966 | Angele et al. | 439/883 |
| 3,500,295 | 3/1970 | Faber et al. | 439/686 |
| 3,721,941 | 3/1973 | Wisser | 439/686 |
| 4,319,799 | 3/1982 | Pearce, Jr. | 439/695 |
| 4,865,562 | 9/1989 | Burg et al. | 439/885 |

*Primary Examiner*—Joseph H. McGlynn
*Assistant Examiner*—Hien D. Vu
*Attorney, Agent, or Firm*—Armstrong, Nikaido, Marmelstein, Kubovcik & Murray

[57] ABSTRACT

In a contact plug connector to be coupled with a socket having contact ends, the contact plug includes an insulative body which encloses a plurality of separated terminal liune extender strips combined with two unslotted carrier ends, an insulative base which mounts with the body such that contact mounts for the extenders strips are accessible for electrical contact, and a housing which encloses the body and the base. The extender strips are formed on one metal plate in this invention, but are defined and separated by slots formed on the metal plate. Although these extender strips are fragile, their handling becomes convenient with the unslotted carrier ends that are cut off in the process of assembling the plug connector.

2 Claims, 5 Drawing Sheets

ELECTRICAL PLUG CONNECTOR

FIELD OF THE INVENTION

This invention relates to a plug connector suitable to connection to a socket mounted on an electronic device. In particular, this invention relates to a plug connector which will be attached to a socket by sliding action.

DESCRIPTION OF THE CONVENTIONAL ART

Conventional plugs having a plurality of plugging elements have been manufactured by such a process that, first the necessary number of the plug terminals, made of a metal, are prepared individually and then arranged side by side for plastic insert molding to enclose the terminals within an insulative plastic material, generally called a body. In addition to the body, a base which will be mounted on the body, and a housing which will cover exposed portions of the base. These components together form a plug unit. In the case noted above, the individual terminals are initially treated separate. When a particular plug needs four (4) lines, four metal terminals should be arranged for the purpose of the insert molding. This conventional processing has required elaborate manual handling of the thin, fragile terminals, which has made the insert molding a time-consuming and inefficient production process.

This invention has proceeded from such disadvantages as noted and is proposed to overcome difficulties attended with the conventional art.

SUMMARY OF THE INVENTION

The present invention plug is intended to connect a socket which has a specified number of contact pins, wherein the terminals manufactured as extension lines or extender strips which extend from the ends of their respective elementary lines, are not separated initially, but are formed as a single unit or in the form of a plate on which slots are cut and two ends are not cut. The uncut portions act as carrier strips for the terminals. Therefore, a metal plate comprising the slots and the carrier strips is employed in this invention. The plate is subjected to the insert molding process to form a body, and then a base is mounted to the body to form a plug with full definition. Thus, in this invention, the extension lines are formed initially as a unit and, through the insert molding, the lines are secured in the body each separately, which greatly contributes to improvement in the production of the inventive articles.

DESCRIPTION OF THE EMBODIMENT(S)

Figure 7:
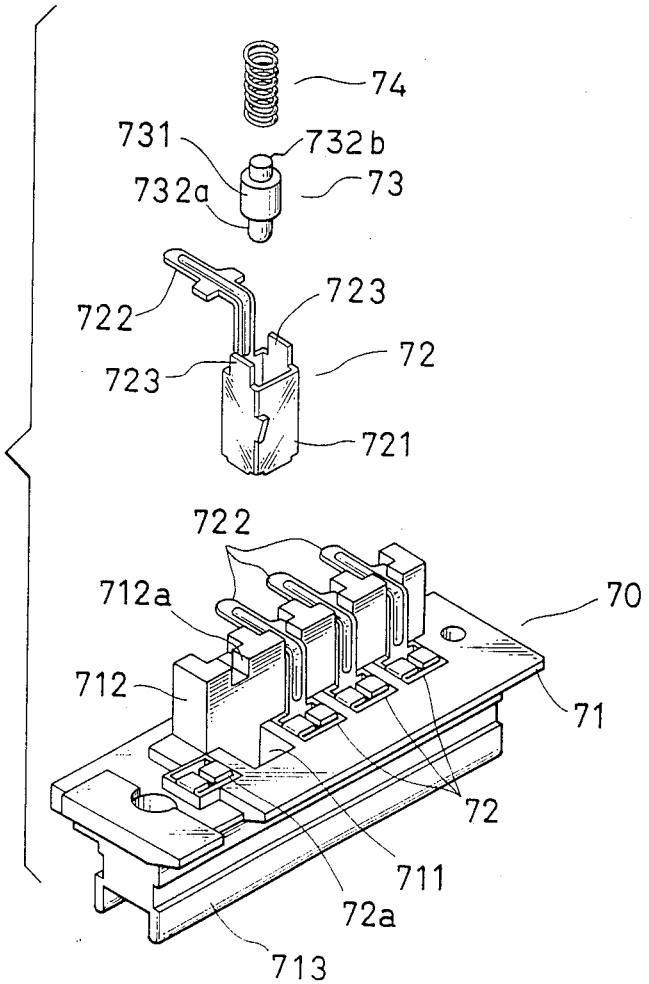
FIG. 7 shows an exploded perspective view of a socket which is designed to couple with the plug. These drawings are presented by way of illustrating the invention and therefore, these should not be construed as limiting the invention.

The embodiment(s) will be described with reference to the drawings, but, for convenience, before entering into description of the plug 1, the socket 70 for the plug 1 will be first explained with reference to FIG. 7.

The socket 70 is designed to be mounted on a cabinet box of an electronic device, for instance, and it comprises a socket body 71, a plurality of terminals 72 which are each to be engaged into wells 711 formed in the body 71, a contact pin 73 which is to be received in each terminal 72, and a spring 74 which is to be also received in each terminal 72.

The body 71 is a molded article of a plastic material and has a plurality of wells 711 arranged in line. (In the drawing, four wells are formed and three of them are filled with the terminals 72.) Adjacent to the line of the wells 711, a wall 712 is formed on which the connecting ends 722 of the terminals 72 are each placed. Specifically, on each top of the wall 712, a notch **712*a* is formed to receive the end 722. The underside portion of the socket body 71 is used to engage to the plug 1, for which two opposite guideways 713** are formed.

The terminal 72 has a generally square cylinder portion 721 and two upward ends 723 thereon, in addition to the connecting end 722 which is also formed integrally. The cylinder portion 721 is designed to receive the contact pin 73 and the spring 74. With the spring 74 urged, the pin 73 and the spring 74 are put into the cylinder portion 721 with two ends 723 bent. The contact pin 73 having two slendered ends **732*a* and 732*b* and blocked center portion 731 will be urged downward. One end 732*a* located underside will form a contact end at the bottom of the cylinder portion 721 with aid of the spring action. Then, the connecting end 722 will be connected with another terminal end which proceeds from an electronic device. The socket 70 is assembled by fitting the terminals 72 each containing the pin 73 and the spring 74 into the wells 711. FIG. 7 shows a terminal-like part 72*a* having no connecting end, located in the most left position of the well line. This terminal-like part 72*a*** is a dummy which will be of help in positioning which terminal should be in place. The terminal-like dummy part is not used in electrical connection.

Figure 2A:
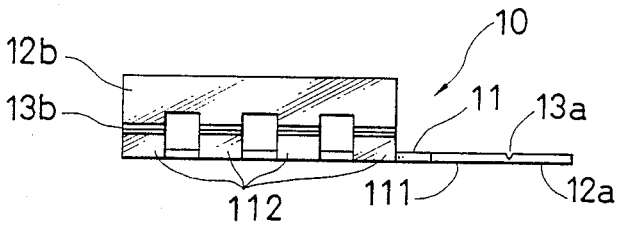
FIG. 2 shows a terminal, of which a front elevation view is shown in (a) and a plan view is shown in (b).
Figure 2B:
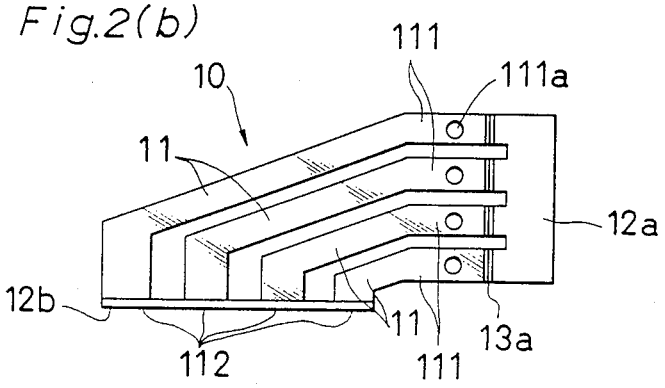
Figure 5:
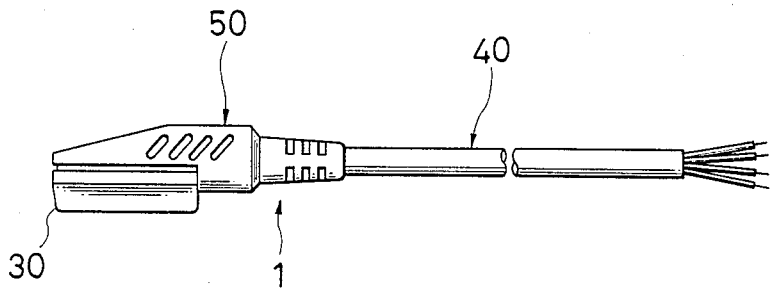
FIG. 5 shows a front elevation view of the plug in accordance with the present invention.

Making reference to the plug 1, as shown in FIG. 2 this part comprises a plug terminal 10, a plug body 20 which encloses the plug terminal 10, a base 30 on which the body 20 is mounted, a lead line 40 which is connected to the terminal 10, and a housing 50 (see FIG. 5) which covers the body 20.

Figure 1:
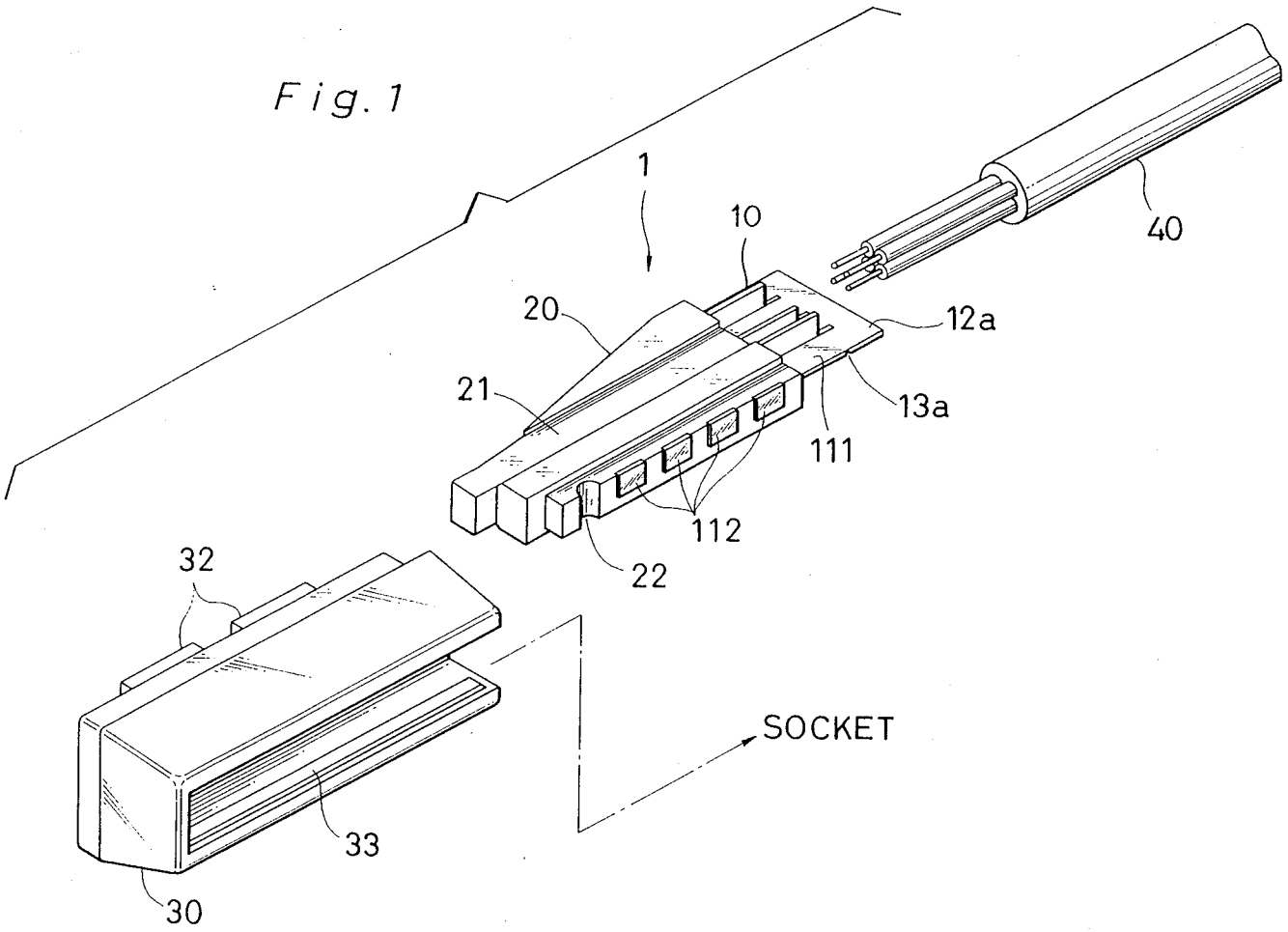
FIG. 1 shows an exploded perspective drawing of a plug connector in accordance with the present invention.

The plug terminal 10, made of a metal plate by press molding, has a slotted plate forming a plurality of line extender strips 11, separated from each other by the slots. As shown in FIG. 2(*a*) and (*b*), four line extenders are constructed at an angle, but lined colinear with one another. At two opposite ends of the plate provided integrally are carrier portions **12*a*, 12*b* for combining the extender strips so that the plurality of the extender strips may be manipulated together. On this terminal plate, adjacent to the carrier portion 12***a*, line connection mounts 111 are formed which comprise holes 111*a* for soldering the line ends. The other end referenced 112 of the extender strips 11 are formed mounts to contact the contact pins 73 carried by the socket 70 (see FIG. 7). Similar to the mounts 111, at the outer ends of mounts 112, the terminal plate is bent at right angles to form another carrier portion 12*b*. These carrier portions 12*a*, 12*b* are meant to retain a plurality of extender strips 11 as a singular piece, and as will be apparent later, these portions 12*a*, 12*b* will be cut away from the plate after terminal 10 is integrated with the body 20. (However, in FIG. 1, the carrier 12*b* only has been cut away, while the carrier 12*a* is still attached.) For ease in cutting, cut-off grooves 13*a*, 13*b* are formed.

Figure 3A:
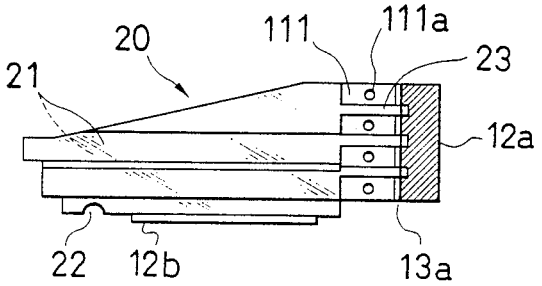
FIG. 3 shows a body after connection with the terminal, of which a plan view is shown in (a) and a front elevation view is shown in (b).
Figure 3B:
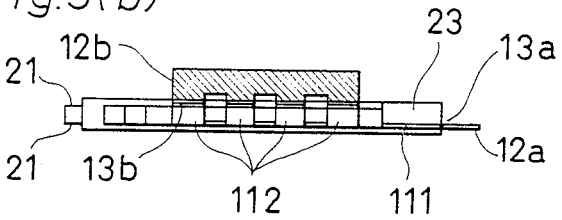
Figure 4A:
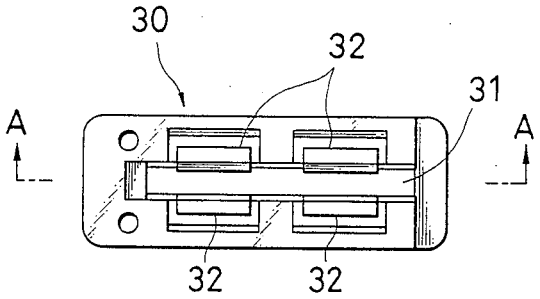
FIG. 4 shows a base, of which a plan view is shown in (a), a front elevation view is shown in (b), a sectional view along the line A—A indicated in (a) is shown in (c), and a sectional view along the line B—B indicated in (b) is shown in (d).
Figure 4B:
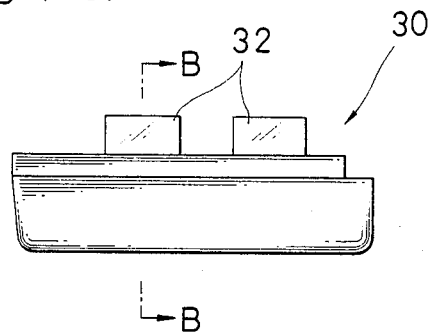
Figure 4D:
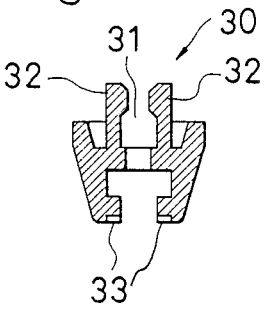
Figure 4C:
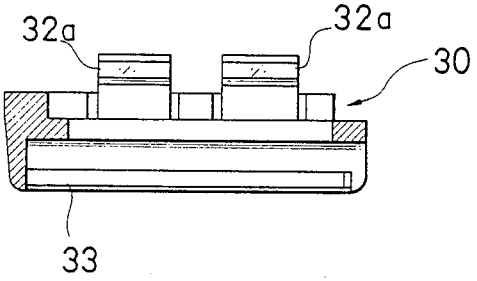
Figure 6B:
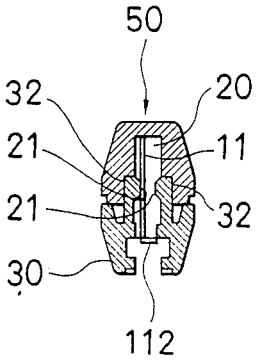
FIG. 6 also shows the plug, of which a sectional front view is shown in (a) and a sectional view along the line C—C in (a) is shown in (b).
Figure 6A:
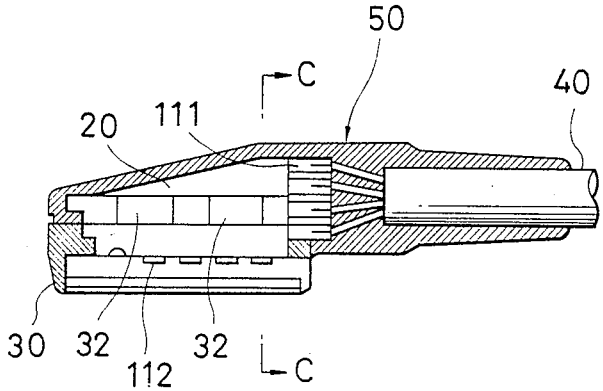

The terminal 10 described above is secured to the body 20 in the process of molding the body 20, made of an insulative plastic, by the art of insert molding. In other words, the body 20 is molded enclosing the terminal 10 excepting the portions 111, 112, 12*a*, and 12*b* and sealing it with a plastic material. Accordingly, the body 20 has a shape similar to the terminal 10 as shown in FIG. 3, which shows the carrier portions 12*a* and 12*b* in hatchings. The body 20 is provided with a pair of hitching grooves 21 which will engage with a pair of gates 32 of the base 30 (see FIG. 4). Each of the gates 32 comprises a pair of walls 32 as will be apparent in FIGS. 4 and 6. The body 20 is engaged into an interspace between the paired gates 32, which makes a connection of these two components of the body 20 and the base 30. See FIG. 6(*b*). In FIG. 3, 22 indicates a cut which will be used a guide for positioning the plug with respect to the socket 70 as was noted before with reference to the dummy 72*a* of the socket. When the body 20 has been fabricated by the insert molding, the carrier portions 12*a*, 12*b* are cut off the terminal plate 11, thereby making the plurality of the extender strips (in this embodiment, four) independent. However, before cutting off the carrier portions, the lead line 40 should be soldered on the mount 111 of the plug terminal 10, wherein the soldering is recommended to be made on both sides of the plate with aid of the holes 111*a* to complete the attachments and wherein the extender strips are separated from each other with an insulative material to prevent possible shorting troubles that may occur subsequently. The base 30 molded of a plastic material, as shown in FIG. 4, has a walled passageway 31 to fit over the body 20, and the passageway 31 is formed of two pairs of gates 32, each having two opposite walls 32, wherein an inwardly blocked rail 32 is formed on each wall 32 so as to fasten the body 20 by engaging the grooves 21 of the body 21. On the underside of the base 30 forming two opposite walls, a pair of rails 33 are each formed to fit with the socket 70. When the body 20 is mounted with the base 30, the body 20 is disposed such that the contact mount 112 of the terminal 10 carried by the body 20 is placed to be accessible from outside an exposed downward in the interspace of the passageway 31 between the two rails 33. In addition, the body 20 has its upper half exposed out of the base 30. See FIG. 6.

The upper half of the body 20 will be covered with a separate housing 50 or the housing 50 can be fabricated also by the insert molding after the the body 20, the base 30 and the lead lines are connected. In other words, a module comprised of these three components is subjected to the insert molding wherein the module is applied as an insertion to be enclosed with a plastic material to form the housing 50. See FIG. 5.

It is to be noted here that the description above referred to the insert molding for fabricating the body 20 and the housing 50, though, the art is not limited to such art. Alternatively is, for instance, the body can be molded into two halves to assembly which would be coupled to form a body unit. Or the bush 50 may be an article which was independently molded priorly.

Next, the process of mounting the plug 1 with the socket 70 will be explained in the following.

Herein, the socket is assumed to have been mounted on an electronic device, and the guideways 713 of the socket 70 are engaged by sliding with the rails 33 of the base 30. The contact mount 112 of the terminal 10 moves on the contact ends 73 of the socket 70 with a good cleaning effect to form aligned contact between the ends 73 and the mount 112.

Advantages of this invention have been explained through the description heretofore, and it is to be noted here that the advantages are particularly valuable in cases where the extenders 11 are in the form of thin flat lines and should turn or veer to connect the socket as illustrated.

What is claimed is:

1. A contact plug connector for coupling with a socket having a plurality of contact terminals, said contact plug comprising:

a plurality of terminal extender strips formed from a single metal plate with slots cut therein for defining each said extender strip, and with carrier portions attached to first and second ends of all said extender strips so as to maintain all said extender strips together as a single unit prior to final assembly of the contact plug connector, the carrier portions being removed at final assembly for forming separate extender strips;

an insulative body enclosing said plurality of terminal extender strips;

an insulative base mounted to said insulative body, said base and said body enclosing said plurality of extender strips such that the first ends of said separate extender strips are accessible for electrical contact with the socket and the second ends are accessible for electrical connection with conductive wires after final assembly; and a housing for enclosing said base and said body.

2. A method for assembling a contact plug connector for coupling with a socket, the method comprising the steps of:

making a plurality of terminal extender strips formed from a single metal plate wherein the metal plate is cut with slots defined therein to thereby define the plurality of extender strips and carrier portions at first and second ends of the extender strips that maintain the extender strips together as a single unit prior to final assembly;

enclosing the plurality of extender strips in an insulative body;

removing the carrier portions from the extender strips to thereby separate the extender strips;

mounting the insulative body with an insulative base such that the first ends of said extender strips are accessible for electrical contact with the socket and the second ends of said extender strips are accessible for electrical connection with conductive wires;

connecting the second ends of each extender strips with conductive wires; and enclosing the base and body in a housing.

* * * * *